US005897263A

United States Patent [19]

Fattori

[11] Patent Number: 5,897,263

[45] Date of Patent: Apr. 27, 1999

[54] COSMETIC DISPENSING PACKAGE

[75] Inventor: Joseph Edward Fattori, Mendham, N.J.

[73] Assignee: Colgate-Palmolive Company, New York, N.Y.

[21] Appl. No.: 08/844,965

[22] Filed: Apr. 23, 1997

[51] Int. Cl.[6] ..... A45D 40/02; A45D 40/16

[52] U.S. Cl. ..... 401/82; 401/87; 401/98

[58] Field of Search ..... 401/82, 83, 84, 401/88, 87, 98

[56] References Cited

U.S. PATENT DOCUMENTS

| | | | |
|---|---|---|---|
| 3,397,027 | 8/1968 | Harrison . | |
| 4,088,412 | 5/1978 | Del Bon . | |
| 4,235,557 | 11/1980 | Hayes | 401/82 X |
| 4,708,507 | 11/1987 | Von Schuckmann . | |
| 4,721,403 | 1/1988 | Zinnbauer . | |
| 4,874,115 | 10/1989 | Weihrauch . | |
| 4,917,133 | 4/1990 | Morel | 401/82 X |
| 5,167,462 | 12/1992 | Lucas . | |
| 5,219,448 | 6/1993 | Hackmann . | |
| 5,326,185 | 7/1994 | Dornbusch et al. | 401/88 |

*Primary Examiner*—Steven A. Bratlie
*Attorney, Agent, or Firm*—Michael McGreal

[57] ABSTRACT

The cosmetic container is comprised of three primary parts. These are a barrel, an elevator, and a cap. The elevator has a cosmetic support surface, anchoring recesses and a well. The barrel is open at the top and usually closed at the bottom, with an adjustment recess in a surface. The well of the elevator slideably fits into the adjustment recess, and preferably conforms to the peripheral shape of the barrel. The well functions as a device to raise the elevator upwardly to dispense product and as a reservoir for the product when it is in a liquid form during the filling of the barrel above the elevator. The well holds the amount of product that is needed for the space between about the top of the barrel and a disposable cover that is used to shape the top of the cosmetic. After the barrel is filled and the disposable cover and cap put in place, the container is inverted with the liquid product flowing from the elevator well to the space between about the top of the barrel and the disposable cover. The product is set to a solid in this orientation.

20 Claims, 2 Drawing Sheets

COSMETIC DISPENSING PACKAGE

FIELD OF THE INVENTION

This invention relates to dispensing packages for solid cosmetics. More particularly, this invention relates to a dispensing package for a solid lipstick or deodorant/antiperspirant. Further, this invention relates to a method of filling such a cosmetic package.

BACKGROUND OF THE INVENTION

There is a need for a low-cost package for dispensing cosmetics such as lipsticks, deodorants and antiperspirants. These particularly are needed for use in countries where consumers have lower incomes. One way to deliver these products at a lower cost is to have a lower cost dispenser. Generally a lower cost dispenser will have fewer parts than the usual dispenser package that can have five or six parts. Fewer parts will mean fewer molds are needed, less plastic is used and less assembly is required. This all translates into a dispensing package that can be produced at a lower cost. In the dispensing package of the present invention, there only will be three primary parts.

The prior art with regard to the present low-cost cosmetic dispenser is illustrated by U.S. Pat. No. 4,721,403; U.S. Pat. No. 5,167,462 and U.S. Pat. No. 5,219,448. In U.S. Pat. No. 4,721,403 there is disclosed a simple dispenser for a solid that consists of three parts. However, the cosmetic must be separately formed and placed in the dispenser. This is a disadvantage since it raises the cost of the product. In U.S. Pat. No. 5,167,462 there is disclosed a related dispenser that is comprised of about five primary parts. This is an interesting structure but it is rather complex and requires more production equipment and more assembly than the cosmetic dispenser of the present invention. U.S. Pat. No. 5,219,448 discloses an ointment applicator. This shows a dispenser where a piston is pushed from a lower end to dispense the ointment from the other end. This dispenser has many parts and a complex structure.

The present invention solves the problem of providing a low-cost solid cosmetic dispensing package. The dispensing package is comprised of three primary parts; a barrel, an elevator and a closure. These are easily assembled and filled. In addition, the solid cosmetic can be produced with a top surface of essentially any shape. This can be of a rounded or other shape. The dispensing package conveniently can be top filled and inverted to shape the top as the cosmetic sets to a solid while maintaining product adhesion to the elevating platform. Further, the package itself can be of various shapes, including an oval shape to produce a wide stick that is a useful form for deodorants and antiperspirants.

BRIEF SUMMARY OF THE INVENTION

The present invention solves the problem of a package for a solid cosmetic that has few parts and is of a low cost. The dispenser package has three primary parts. There is a barrel, an elevator and a closure. There also is an auxiliary closure that is needed only during filling and is discarded at the time of first use.

The cosmetic package is comprised of a barrel open at an upper end, and preferably substantially closed at a lower end. The barrel has an adjustment recess in one surface, the adjustment recess extending at least partially the longitudinal dimension of the barrel. The adjustment recess is open into the barrel interior at an upper end.

An elevator slideably fits into the barrel with an elevator well portion being of a shape complementary to the adjustment recess and fitting into the recess. The upper part of the elevator has a cosmetic support. The cosmetic support has a plurality of anchoring recesses. Each of the anchoring recesses is connected to the well by means of a vent channel. The vent channels function to vent air from the recesses during the filling process and when the package is inverted with the product in a liquid state of the package with the cosmetic. The well area of the elevator functions as a reservoir for the cosmetic during filling and during use as the means to raise the elevator to apply the cosmetic.

Above the barrel is an auxiliary closure and a permanent closure. The auxiliary closure can be supported on the top edge of the barrel. The permanent closure is supported by a ledge on the barrel. The auxiliary closure is supported on the upper edge of the barrel and is needed only for filling the package and usually is discarded at the time of first use.

The cosmetic package is filled by assembling the elevator into the barrel, lowering the elevator until the volume between the elevator and the auxiliary closure is of the desired volume, and filling the barrel to near the top edge. The auxiliary closure and the permanent closure then are put into place. The cosmetic package then is inverted and the cosmetic set to a solid, for instance by cooling. The cosmetic package then is uprighted.

It is an object to provide a low-cost cosmetic package having a minimal number of primary parts.

It is a further object to provide a cosmetic package that has three primary parts and a shaped upper surface.

It is an additional object to provide a cosmetic package in an oval form so that the cosmetic can be in the form of a wide stick.

These and other objects are described in more detail herein.

DETAILED DESCRIPTION OF THE DRAWINGS

The present cosmetic dispensing package will be described in more detail with reference to the accompanying drawings. The dispenser is comprised of three principal parts. There is a barrel, an elevator and a cap closure. A part of the elevator provides the means to move the elevator upwards to expose more of the cosmetic for use and to hold the cosmetic in a set position during use. Also, in a preferred embodiment the dispenser is oval, i.e. elliptical in shape. In deodorant use this is an advantage since it provides a wide surface which aids in the application of the deodorant to a person's underarm area.

Figure 1:
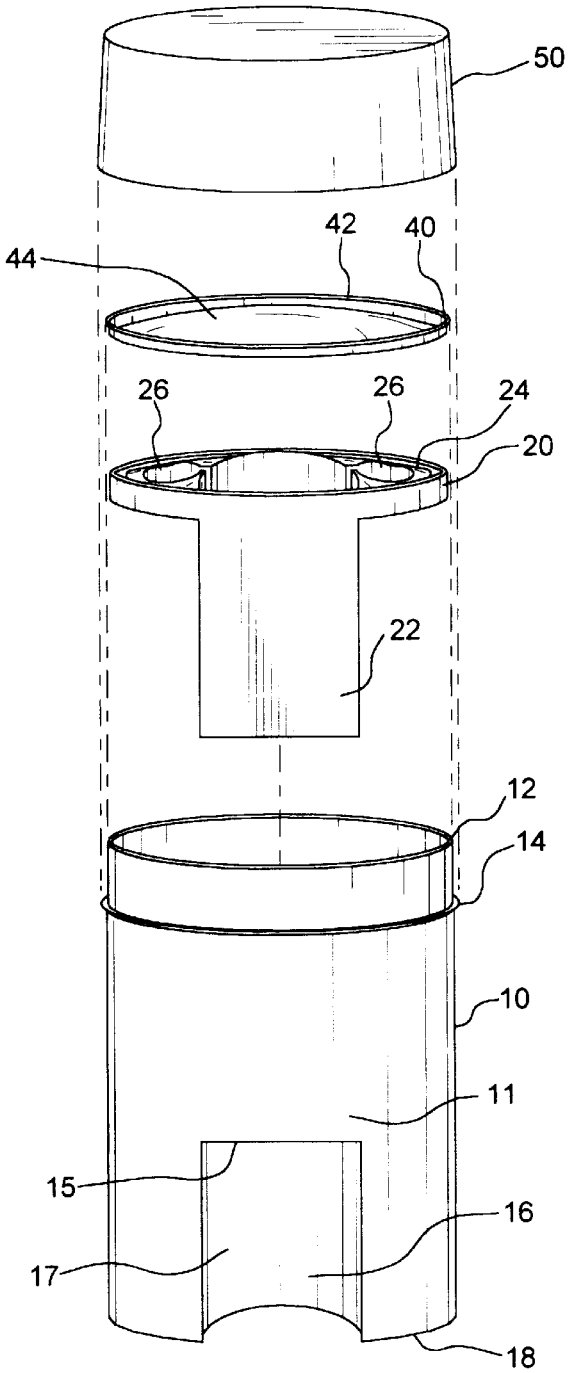
FIG. 1 is an exploded view of the cosmetic dispensing package.

The cosmetic package is shown in an exploded view in FIG. 1. The barrel 10 has an upper edge 12 and a bottom 18. The package is shown in its preferred form which is oval, i.e. elliptical. Surface 11 has an adjustment recess 16. The adjustment recess is open into the barrel at upper end 15. On an upper part of the barrel there is a ledge 14 which limits the portion of the barrel that will be covered by closure 50.

Elevator 20 slideably fits into the barrel 10. The elevator is comprised of cosmetic support portion 24 and side surface 23, with well 22 extending downwardly from the cosmetic support portion. The well has a length of about 50% to about 150% that of the adjustment recess.

Figure 2:
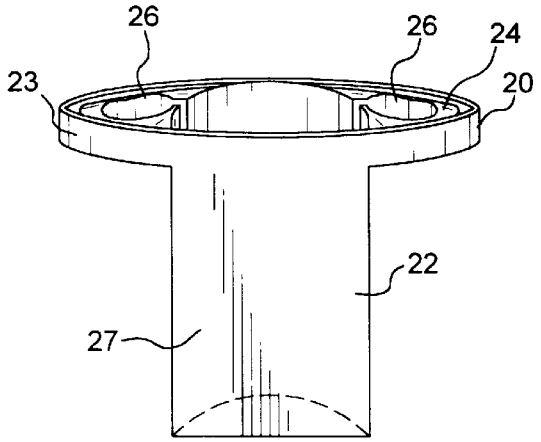
FIG. 2 is a side elevational view of the elevator.
Figure 3:
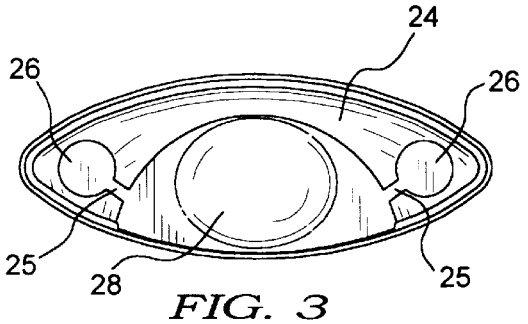
FIG. 3 is a top plan view of the elevator.

The elevator is shown in more detail in FIGS. 2 and 3. The support portion has locking recesses 26 which are connected to the well 22 by vent channels 25. The recesses are filled with the solid cosmetic and anchor the cosmetic to the elevator. The vent channels provide a way to vent air from the recesses during the filing of the barrel and the well area 28 with the liquid cosmetic. The side surface 23 of the elevator contacts the inner surface of the barrel and stabilizes the upper part of the elevator in the barrel. Also, the friction fit between elevator side surface 23 and the inside of the barrel wall prevents the elevator and the product from moving downward during the application of the product to the underarm as well as preventing leakage of the liquid product out of or into the bottom of barrel 10 during filling. The elevator will have lateral dimensions of about that of the lateral internal dimensions of the barrel so as to produce the friction fit. Well wall 27 will contact the wall of barrel recess 16 and will align the elevator in the barrel.

Figure 4:
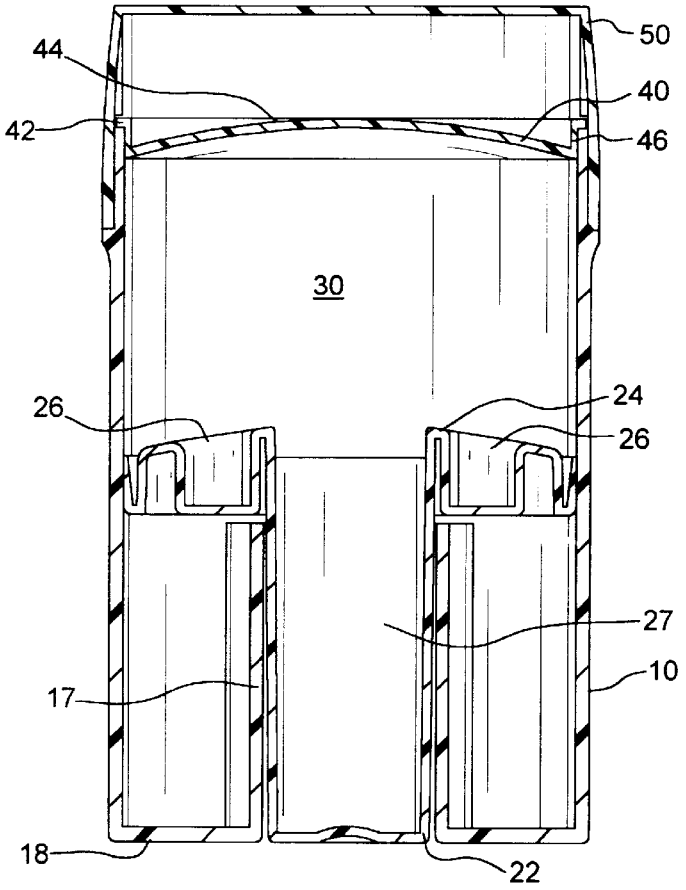
FIG. 4 is a front elevational view in section of the assembled cosmetic package.

The auxiliary closure 40 which is shown in FIG. 1 is a closure that is used during filling to shape the top of the cosmetic. As shown, this has a top edge 42 and an upper domed portion 44. The top of the cosmetic will have a shape similar to this domed portion 44. This auxiliary closure is shown in more detail in FIG. 4. It is seen in FIG. 4 that auxiliary closure top edge 42 sits on barrel top edge 12. Vertical wall 46 of the auxiliary closure connects the top edge 42 of the auxiliary closure to the domed portion 44.

FIG. 4 shows the dispensing container in a more detailed and assembled condition containing a solid cosmetic. This is a sectional view along the major axis. In this view the wall 27 of the elevator well that contacts the wall 17 of the recess is shown in more detail. The space 30 along with recesses 26 and upper part of well 22 will be that which will contain the solid cosmetic.

Figure 5:
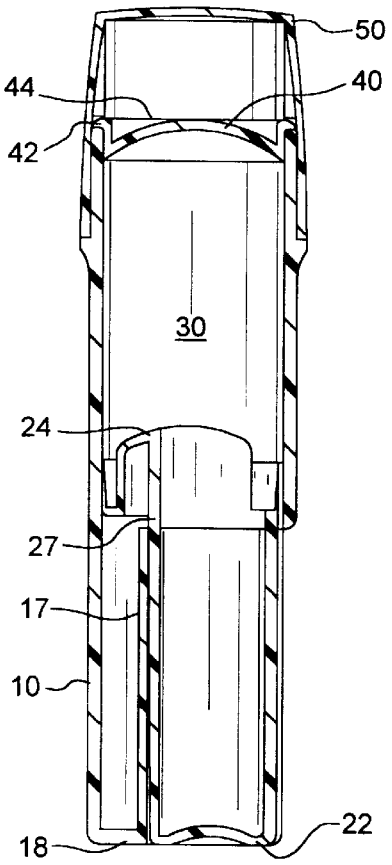
FIG. 5 is a side elevational view in section of the assembled cosmetic package.

FIG. 5 is a sectional view of the cosmetic container along the minor axis. This shows the structure of the elevator well in more detail. The close proximity of the wall 27 of the elevator well and the surface 17 of the adjustment aperture also is shown in more detail.

Figure 6:
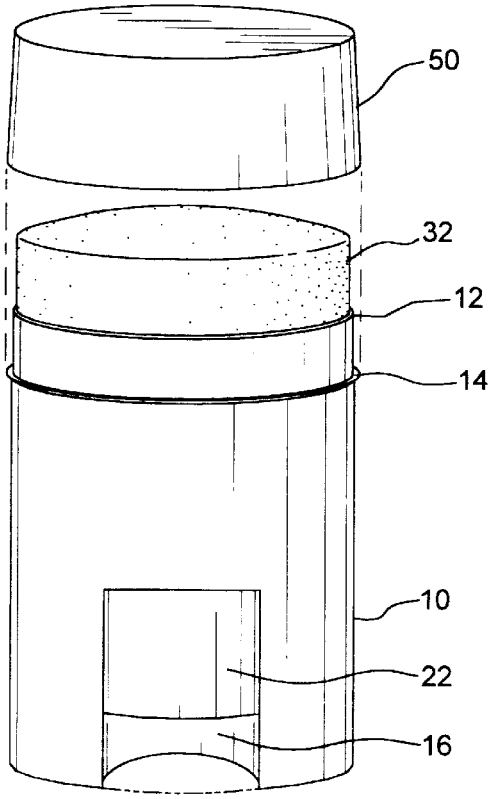
FIG. 6 is an exploded view of the cosmetic package in an assembly for use.

FIG. 6 shows the cosmetic dispensing package in a condition for use. After the removal of closure 50, the auxiliary closure 40 is removed and discarded. This auxiliary closure only is needed during filling of the barrel. It is used to shape the top surface of the cosmetic. During the first use it is removed and discarded. In order to apply the cosmetic 32, the closure 50 is removed, the auxiliary closure 40 removed and discarded and the elevator supporting the cosmetic raised by pushing upwardly on the well 22 which raises the cosmetic above barrel edge 12 for use. This will be repeated until the cosmetic is depleted. The package is then discarded and replaced with another unit.

The cosmetic package is filled by assembling the elevator into the barrel and lowering the elevator until the space between the elevator and the top edge of the barrel has the volume of the amount of cosmetic to be delivered from the package. Usually this will be a point where the bottom of the well part of the elevator is at about the same level as the bottom of the barrel. The barrel, adjustment recesses and well are then filled to about 3 mm to 5 mm below the top edge of the barrel, the auxiliary closure 40 put into place and then the closure 50 put into place. The package then is inverted so that the liquid cosmetic will flow out of the well and will fill the volume of the package between the elevator and the auxiliary closure. Cosmetic will also be in the anchoring recesses and some will be at the top of the well. The cosmetic then is set, for instance by cooling. After the cosmetic sets, the package is uprighted.

The top of the set cosmetic will have a shape that is complementary to that of the auxiliary closure. The only requirement is that the well be of a volume that is the same as, or greater than, the volume above the liquid cosmetic after filling (and prior to inverting) and the auxiliary closure. The auxiliary closure can be of essentially any shape.

The cosmetic package can be constructed of the materials commonly used for lipstick or deodorant and antiperspirant stick products. This includes a wide range of plastic materials.

The best mode of practicing the invention has been described. However, variations of the concepts are possible. All such variations are considered to be within the scope of the present invention.

What is claimed is:

1. A dispensing package for a solid cosmetic comprising:

a barrel, said barrel having an open upper end, a lower end and an adjustment recess in one surface extending a length from said lower end of said barrel to at least partially to said upper end of said barrel;

an elevator to support said solid cosmetic, said elevator having a cosmetic support portion and a well extending downwardly from said cosmetic support portion, said well open only on an upper end thereof, a wall of said well slideably engaging said adjustment recess of said barrel as said elevator is inserted into said barrel to thereby form part of a wall of said barrel and whereby by pushing upwardly on a lower part of said well said elevator is raised upwardly.

2. A cosmetic dispensing package as in claim 1 wherein said well has a length of at least about 50% to about 150% of the length of said adjustment recess.

3. A cosmetic dispensing package as in claim 2 wherein said well has a length of about the length of said adjustment recess.

4. A cosmetic dispensing package as in claim 1 wherein said cosmetic support portion of said elevator has a plurality of means to anchor said solid cosmetic onto said cosmetic support portion.

5. A cosmetic dispensing package as in claim 4 wherein said means to anchor are a plurality of anchor recesses in said cosmetic support portion.

6. A cosmetic dispensing package as in claim 4 wherein there is a vent channel connecting each of said means to anchor and said well.

7. A cosmetic dispensing package as in claim 1 wherein said open upper end of said barrel is closed by at least one closure.

8. A cosmetic dispensing package as in claim 7 wherein there are two closures.

9. A cosmetic dispensing package as in claim 7 wherein said well has a volume at least the volume of a space defined by about a top edge of said barrel and said at least one closure.

10. A cosmetic dispensing package as in claim 1 wherein said adjustment recess is open at an upper end and at a lower end and has a shape complementary to the shape of said well so that said well, and thus said elevator, is supported in said adjustment recess.

11. A cosmetic dispensing package as in claim 1 wherein said barrel is elliptical in shape with said adjustment recess in a surface defined by the major axis of said elliptical shape.

12. A cosmetic dispensing package as in claim 1 wherein said lower end of said barrel is substantially closed.

13. A cosmetic dispensing package as in claim 1 wherein a surface of said well forms a part of a surface of said barrel.

14. A cosmetic dispensing package as in claim 1 wherein said elevator has lateral dimensions of about the internal lateral dimensions of said barrel whereby a periphery of said elevator contacts and frictionally grips the internal surface of said barrel to provide a liquid seal between said elevator and said barrel and to assist in maintaining said elevator at a set level during use.

15. A dispensing package for a solid cosmetic comprising:

a barrel, said barrel having an open upper end, a lower end and an adjustment recess in one surface extending a length from said lower end of said barrel to at least partially to said upper end of said barrel;

an elevator to support said solid cosmetic, said elevator having a cosmetic support portion and a well extending downwardly from said cosmetic support portion, said well adapted to slideably engage said adjustment recess of said barrel as said elevator is inserted into said barrel, said well having a length of at least about 50% to about 150% of the length of said adjustment recess, and a volume at least the volume defined by a space of proximate the top edge of said barrel and a closure closing the open upper end of said barrel.

16. A cosmetic dispensing package as in claim 15 wherein said adjustment recess is open at an upper end and at a lower end and has a shape complementary to the shape of said well so that said well, and thus said elevator, is supported in said adjustment recess.

17. A cosmetic dispensing package as in claim 15 wherein said barrel is elliptical in shape with said adjustment recess in a surface defined by the major axis of said elliptical shape.

18. A method of filling a cosmetic dispensing package comprising a barrel and an elevator slideably supported in said barrel, said elevator having a cosmetic support portion and a well extending downwardly from said cosmetic support portion, a portion of the surface of said well forming a part of the surface of said barrel, said method comprising:

assembling said elevator into said barrel and moving said elevator to a lower position in said barrel;

filling said barrel above said elevator and said well with a cosmetic in a liquid form but which can set to a solid, said liquid cosmetic substantially filling said well;

placing a closure on said barrel above said cosmetic;

inverting said barrel with said closure in place whereby a substantial portion of said liquid cosmetic flows from said well to a space between said elevator and said closure; and allowing said liquid cosmetic to set to a solid.

19. A method of filling a cosmetic dispenser as in claim 18 wherein said barrel is filled with said liquid cosmetic to about 3 mm to about 5 mm below a top edge of said barrel.

20. A method as in claim 18 wherein said liquid cosmetic is set by cooling.

* * * * *